US009847091B2

(12) United States Patent
Tsujikawa et al.

(10) Patent No.: US 9,847,091 B2
(45) Date of Patent: Dec. 19, 2017

(54) SPEECH PROCESSING APPARATUS, SPEECH PROCESSING METHOD, SPEECH PROCESSING PROGRAM, METHOD OF ATTACHING SPEECH PROCESSING APPARATUS, CEILING MEMBER, AND VEHICLE

(71) Applicant: NEC Corporation, Minato-ku, Tokyo (JP)

(72) Inventors: Masanori Tsujikawa, Tokyo (JP); Ken Hanazawa, Tokyo (JP); Akihiko Sugiyama, Tokyo (JP)

(73) Assignee: NEC CORPORATION, Tokyo (JP)

( * ) Notice: Subject to any disclaimer, the term of this patent is extended or adjusted under 35 U.S.C. 154(b) by 0 days.

(21) Appl. No.: 14/766,785

(22) PCT Filed: Jan. 16, 2014

(86) PCT No.: PCT/JP2014/050653
§ 371 (c)(1),
(2) Date: Aug. 10, 2015

(87) PCT Pub. No.: WO2014/125860
PCT Pub. Date: Aug. 21, 2014

(65) Prior Publication Data

US 2016/0049161 A1 Feb. 18, 2016

(30) Foreign Application Priority Data

Feb. 12, 2013 (JP) ..... 2013-025001

(51) Int. Cl.
*H04R 3/00* (2006.01)
*G10L 21/0208* (2013.01)
*G10L 21/0216* (2013.01)

(52) U.S. Cl.
CPC ..... *G10L 21/0208* (2013.01); *G10L 21/0216* (2013.01); *H04R 3/005* (2013.01);
(Continued)

(58) Field of Classification Search
CPC ..... G10L 21/0208; G10L 21/0216; G10L 2021/02165; H04R 3/005; H04R 2410/05; H04R 2499/13
See application file for complete search history.

(56) References Cited

U.S. PATENT DOCUMENTS

2004/0059571 A1 3/2004 Ohtomo
2004/0138882 A1* 7/2004 Miyazawa ..... G10L 15/065 704/233

(Continued)

FOREIGN PATENT DOCUMENTS

JP 2003-111185 A 4/2003
JP 2004-120717 A 4/2004

(Continued)

OTHER PUBLICATIONS

International Search Report for PCT Application No. PCT/JP2014/050653 dated Apr. 1, 2014.

*Primary Examiner* — Sonia Gay

(57) ABSTRACT

To input the voice of the passenger of a vehicle and output a piece of high-quality enhanced speech independently of the direction of a piece of speech or noise, a speech processing apparatus includes a first microphone that is provided on one of a ceiling member in a vehicle and an accessory thereof, inputs a sound mixture including a voice of a passenger of the vehicle and noise in the vehicle, and outputs a first signal, a second microphone that is provided on one of the ceiling member in the vehicle and the accessory thereof at a position farther than the first microphone when viewed from the passenger of the vehicle, inputs the noise in the vehicle while insulating the voice of (Continued)

the passenger of the vehicle using one of the ceiling member of the vehicle and the accessory thereof, and outputs a second signal, and a noise suppressor that outputs an enhanced speech signal based on the first signal and the second signal.

8 Claims, 13 Drawing Sheets

(52) U.S. Cl.
CPC *G10L 2021/02165* (2013.01); *H04R 2410/05* (2013.01); *H04R 2499/13* (2013.01)

(56) References Cited

U.S. PATENT DOCUMENTS

| | | | | |
|---|---|---|---|---|
| 2006/0031067 | A1 | 2/2006 | Kaminuma | |
| 2006/0174581 | A1* | 8/2006 | Katcherian | B60J 1/005 52/716.5 |
| 2006/0178169 | A1 | 8/2006 | Dunn, Jr. et al. | |
| 2011/0211705 | A1* | 9/2011 | Hutt | H04R 29/001 381/59 |
| 2012/0284023 | A1* | 11/2012 | Vitte | H04M 9/082 704/233 |

FOREIGN PATENT DOCUMENTS

| | | | |
|---|---|---|---|
| JP | 2006-050303 | A | 2/2006 |
| JP | 2006-222969 | A | 8/2006 |
| WO | 2012/096072 | A1 | 7/2012 |
| WO | 2012/165657 | A1 | 12/2012 |

* cited by examiner

SPEECH PROCESSING APPARATUS, SPEECH PROCESSING METHOD, SPEECH PROCESSING PROGRAM, METHOD OF ATTACHING SPEECH PROCESSING APPARATUS, CEILING MEMBER, AND VEHICLE

This application is a National Stage Entry of PCT/JP2014/050653 filed on Jan. 16, 2014, which claims priority from Japanese Patent Application 2013-025001 filed on Feb. 12, 2013, the contents of all of which are incorporated herein by reference, in their entirety.

TECHNICAL FIELD

The present invention relates to a technique of acquiring a signal from a sound mixture including noise and a desired signal.

BACKGROUND ART

In the above technical field, patent literature 1 discloses a technique of providing a sound insulating member between two microphones and acquiring a piece of speech in a sound space where a piece of speech and noise coexist.

CITATION LIST

Patent Literature

Patent literature 1: International Publication No. 2012/096072

SUMMARY OF THE INVENTION

Technical Problem

In the technique described in the above literature, however, an L-shaped or conical sound insulating member is provided aiming at increasing the difference between pieces of speech input to the two microphones. Hence, it is sometimes impossible to acquire a piece of speech of much higher level as compared to noise depending on the direction of the piece of speech or noise.

The present invention enables to provide a technique of solving the above-described problem.

Solution to Problem

One aspect of the present invention provides a speech processing apparatus comprising:

a first microphone that is provided on one of a ceiling member in a vehicle and an accessory thereof, inputs a sound mixture including a voice of a passenger of the vehicle and noise in the vehicle, and outputs a first signal;

a second microphone that is provided on one of the ceiling member in the vehicle and the accessory thereof at a position farther than the first microphone when viewed from the passenger of the vehicle, inputs the noise in the vehicle while insulating the voice of the passenger of the vehicle using one of the ceiling member of the vehicle and the accessory thereof, and outputs a second signal; and a noise suppressor that outputs an enhanced speech signal based on the first signal and the second signal.

Another aspect of the present invention provides a speech processing method comprising:

inputting a sound mixture including a voice of a passenger of a vehicle and noise in the vehicle and outputting a first signal using a first microphone provided on one of a ceiling member in the vehicle and an accessory thereof;

inputting the noise in the vehicle while insulating the voice of the passenger of the vehicle using one of the ceiling member of the vehicle and the accessory thereof and outputting a second signal using a second microphone provided on one of the ceiling member in the vehicle and the accessory thereof at a position farther than the first microphone when viewed from the passenger of the vehicle; and outputting an enhanced speech signal based on the first signal and the second signal.

Still other aspect of the present invention provides a speech processing program for causing a computer to execute a method comprising:

inputting a sound mixture including a voice of a passenger of a vehicle and noise in the vehicle and outputting a first signal using a first microphone provided on one of a ceiling member in the vehicle and an accessory thereof;

inputting the noise in the vehicle while insulating the voice of the passenger of the vehicle using one of the ceiling member of the vehicle and the accessory thereof and outputting a second signal using a second microphone provided on one of the ceiling member in the vehicle and the accessory thereof at a position farther than the first microphone when viewed from the passenger of the vehicle; and outputting an enhanced speech signal based on the first signal and the second signal.

Still other aspect of the present invention provides a method of attaching a speech processing method to a vehicle, the method comprising:

attaching a first microphone that inputs a sound mixture including a voice of a passenger of a vehicle and noise in the vehicle and outputs a first signal to on one of a ceiling member in the vehicle and an accessory thereof;

attaching a second microphone that inputs the noise in the vehicle while insulating the voice of the passenger of the vehicle using one of the ceiling member of the vehicle and the accessory thereof and outputs a second signal to one of the ceiling member in the vehicle and the accessory thereof at a position farther than the first microphone when viewed from the passenger of the vehicle; and connecting the first microphone and the second microphone to a noise suppressor that outputs an enhanced speech signal, based on the first signal and the second signal.

Still other aspect of the present invention provides a ceiling member comprising the speech processing apparatus.

Still other aspect of the present invention provides a vehicle comprising the speech processing apparatus.

Advantageous Effects of Invention

According to the present invention, it is possible to input the voice of the passenger of a vehicle and output a high-quality enhanced speech signal independently of the direction of a piece of speech or noise.

DESCRIPTION OF THE EMBODIMENTS

Preferred embodiments of the present invention will now be described in detail with reference to the drawings. It should be noted that the relative arrangement of the components, the numerical expressions and numerical values set forth in these embodiments do not limit the scope of the present invention unless it is specifically stated otherwise. Note that "speech signal" in the following explanation indicates a direct electrical change that occurs in accordance with the influence of speech or another sound. The speech signal transmits speech or another sound.

First Embodiment

A speech processing apparatus 100 according to the first embodiment of the present invention will be described with reference to FIG. 1. The speech processing apparatus 100 is an apparatus configured to suppress noise in a car and extract the voice of a passenger.

Figure 1:
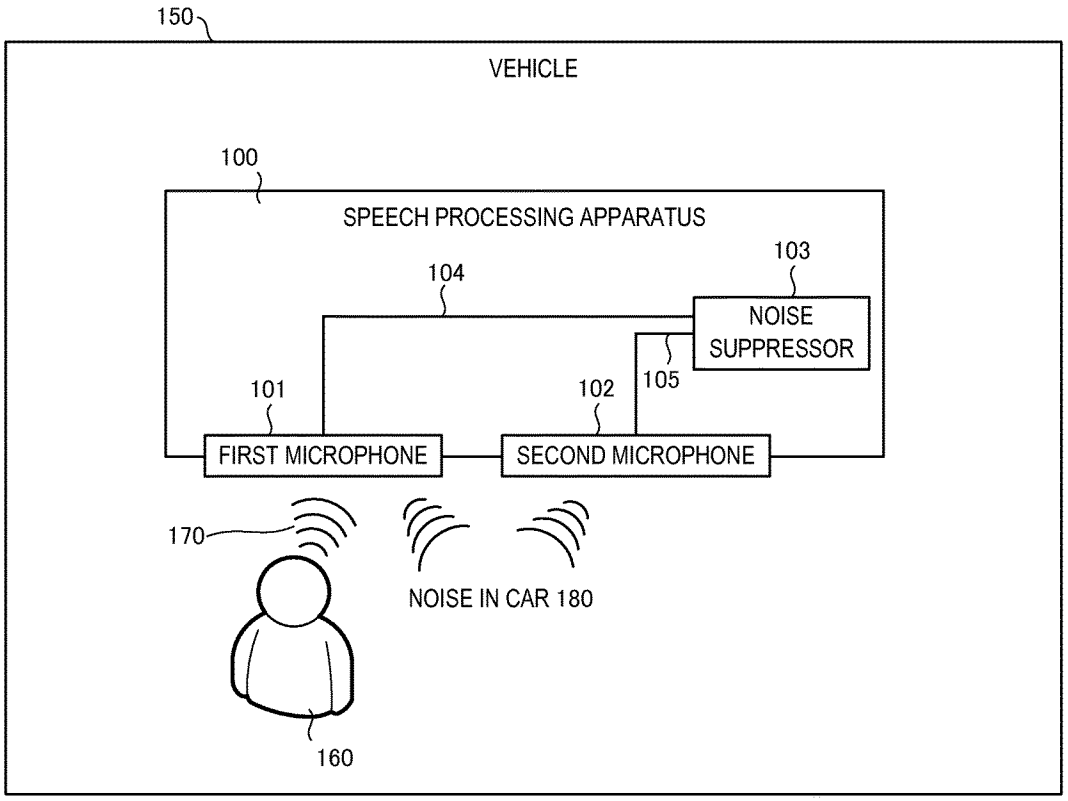
FIG. 1 is a block diagram showing the arrangement of a speech processing apparatus according to the first embodiment of the present invention.

As shown in FIG. 1, the speech processing apparatus 100 includes a first microphone 101, a second microphone 102, and a noise suppressor 103.

The first microphone 101 is provided on the ceiling member in a vehicle 150 or an accessory thereof, inputs a sound mixture including a voice 170 of a passenger 160 of the vehicle 150 and noise 180 in the vehicle, and outputs a first signal 104.

The second microphone 102 is provided on the ceiling member in the vehicle 150 or an accessory thereof at a position farther than the first microphone 101 when viewed from the passenger 160 of the vehicle 150, inputs the noise 180 in the vehicle while insulating the voice 170 of the passenger 160 of the vehicle 150 using the ceiling member of the vehicle 150 or the accessory thereof, and outputs a second signal 105.

The noise suppressor 103 outputs an enhanced speech signal based on the first signal 104 and the second signal 105.

According to the above-described arrangement, the voice of the passenger of the vehicle is insulated using the ceiling member of the vehicle or an accessory thereof. It is therefore possible to input the voice of the passenger of the vehicle and output a high-quality enhanced speech signal while ensuring high productivity.

Second Embodiment

Figure 2:
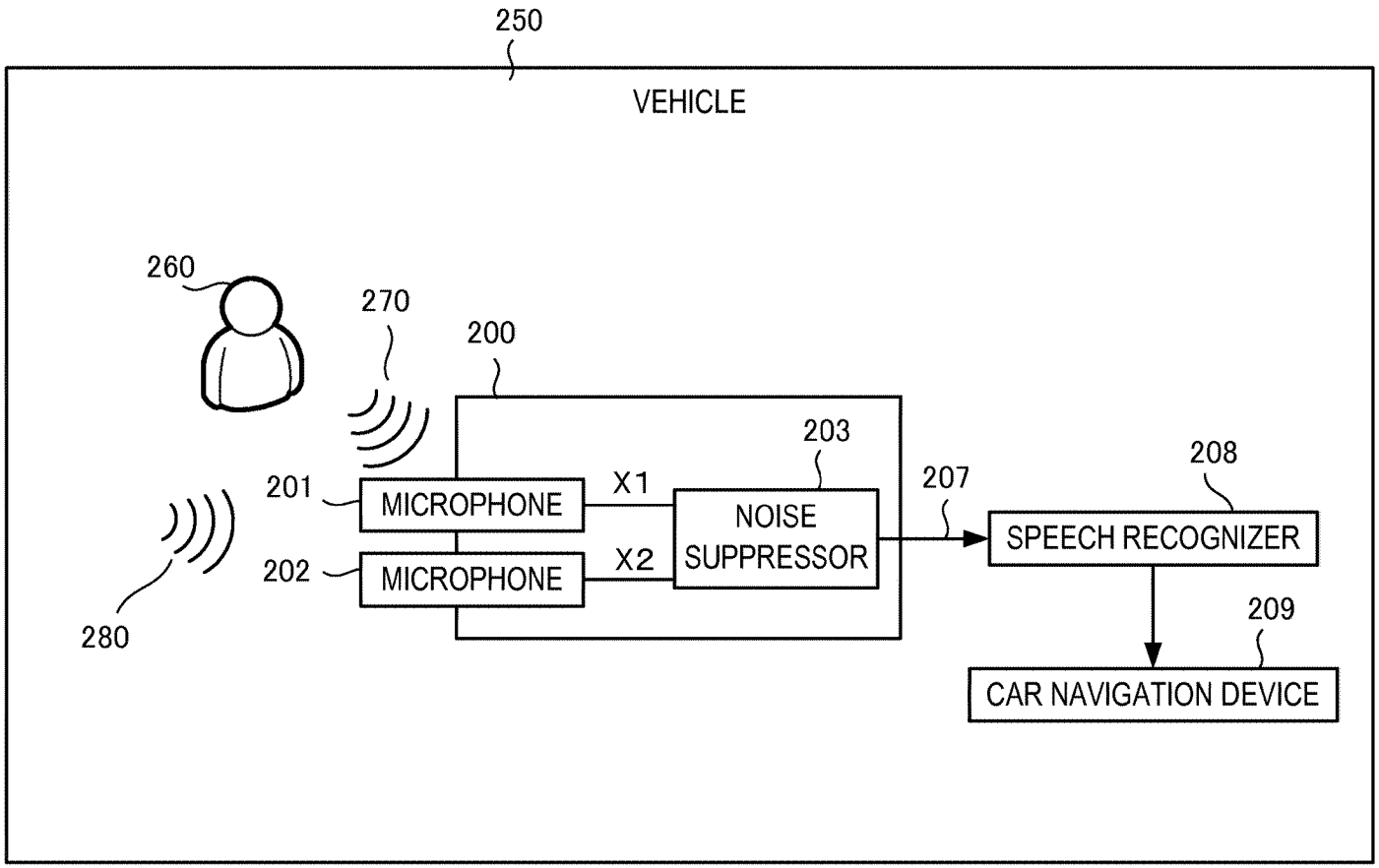
FIG. 2 is a block diagram showing the arrangement of a vehicle according to the second embodiment of the present invention.

A speech processing apparatus according to the second embodiment of the present invention will be described next with reference to FIGS. 2 to 5. FIG. 2 is a block diagram for explaining the overall arrangement of a speech processing apparatus 200 according to this embodiment.

<<Overall Arrangement>>

Referring to FIG. 2, the speech processing apparatus 200 includes a microphone 201 serving as a first microphone, a microphone 202 serving as a second microphone, and a noise suppressor 203, and is connected to a speech recognizer 208 and a car navigation device 209.

The microphone 201 is provided on the ceiling member in a vehicle 250 or an accessory thereof, catches a voice 270 of a passenger 260 of the vehicle 250, outputs a signal X1, and provides it to the noise suppressor 203. The microphone 202 is provided on the ceiling member in the vehicle 250 or an accessory thereof at a position farther than the microphone 201 when viewed from the passenger 260 of the vehicle 250. The microphone 202 catches noise 280 in the vehicle, outputs a signal X2, and provides it to the noise suppressor 203. The noise 280 in the vehicle includes not only noise from the engine, motor, air conditioner, audio system, blinker, and windshield wipers generated in the vehicle but also road noise, sound of rain, sound of wind, and the like generated outside the car.

Both the signal X1 and the signal X2 are mixture signals including a speech signal and a noise signal. The signal X1 includes the speech signal in a relatively large amount. On the other hand, the noise 280 caught by the microphone 201 and that caught by the microphone 202 preferably have no large difference. In other words, the signal X1 includes the speech signal and the noise signal at a ratio different from that in the signal X2, and the ratio of the speech signal is higher in the signal X1 than in the signal X2.

The noise suppressor 203 outputs an enhanced speech signal 207 based on the signal X1 and the signal X2. The speech recognizer 208 recognizes the utterance contents of the passenger 260 based on the enhanced speech signal 207. The car navigation device 209 is operated by the piece of recognized speech. The voice of the passenger 260 is used not only to operate the car navigation device 209 but also for another purpose, for example, to operate the audio system or air conditioner in the car or to do a speech communication via a mobile phone.

<<Arrangement of Noise Suppressor>>

Figure 3:
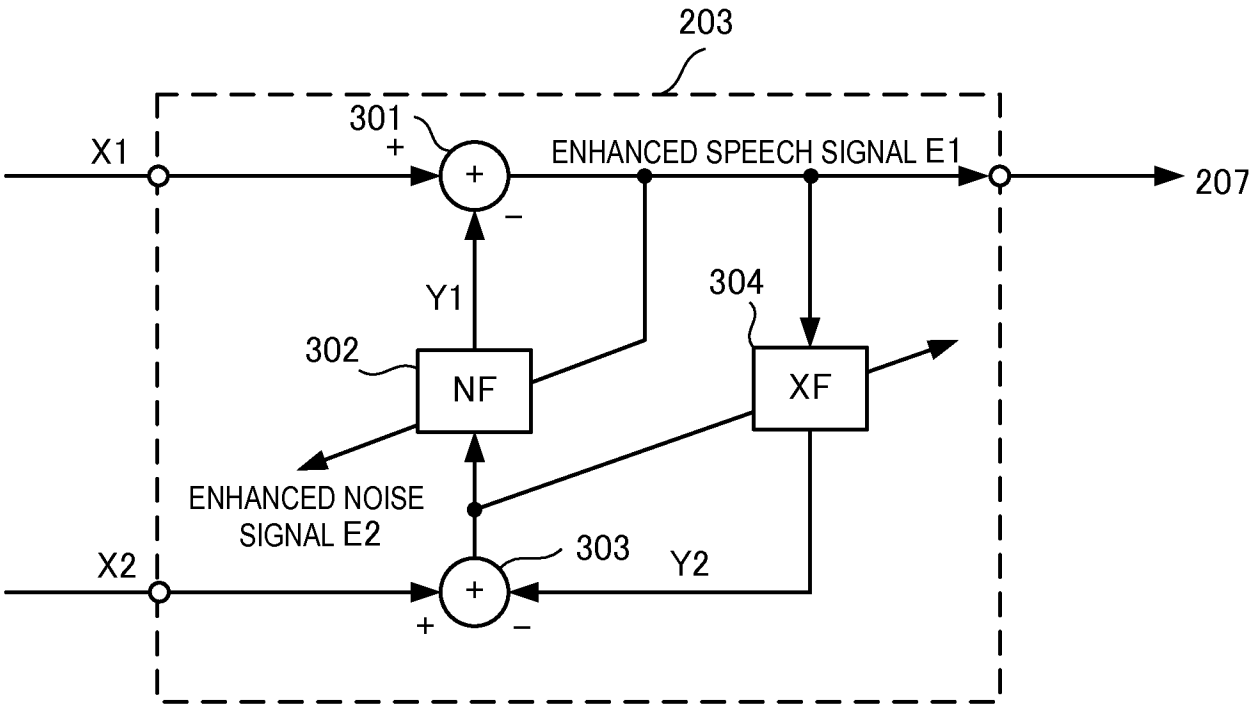
FIG. 3 is a block diagram showing the arrangement of the noise suppressor of a speech processing apparatus according to the second embodiment of the present invention.

FIG. 3 is a block diagram showing the arrangement of the noise suppressor 203 according to this embodiment. The noise suppressor 203 includes a subtracter 301 that subtracts, from the signal X1, an estimated noise signal Y1 estimated to be included in the signal X1 from the microphone 201. The noise suppressor 203 also includes a subtracter 303 that subtracts, from the signal X2, an estimated speech signal Y2 estimated to be included in the signal X2. The noise suppressor 203 also includes an adaptive filter (NF) 302 serving as an estimated noise signal generator that generates the estimated noise signal Y1 from an enhanced noise signal E2 that is the output signal of the subtracter 303. The adaptive filter 302 generates the estimated noise signal Y1 from the enhanced noise signal E2 using a parameter that changes based on an enhanced speech signal E1. The enhanced noise signal E2 is a signal obtained by causing the subtracter 303 to subtract the estimated speech signal Y2 from the signal X2 transmitted from the microphone 202 via a signal line.

The noise suppressor 203 also includes an adaptive filter (XF) 304 serving as an estimated speech signal generator that generates the estimated speech signal Y2 from the enhanced speech signal E1 (207) that is the output signal of the subtracter 301. The adaptive filter 304 generates the estimated speech signal Y2 from the enhanced speech signal E1 using a parameter that changes based on the enhanced noise signal E2. A detailed example of the adaptive filter 304 is described in detail in International Publication No. 2005/024787.

Even if the voice of the passenger 260 is input to the microphone 202, and the speech signal is included in the signal X2, the adaptive filter 304 can prevent the subtracter 301 from erroneously removing the speech signal from the signal X1. With this arrangement, the subtracter 301 subtracts the estimated noise signal Y1 from the signal X1 transmitted from the microphone 201 and outputs the enhanced speech signal E1.

The noise suppressor 203 can be any one of an analog circuit, a digital circuit, and a mixture thereof. When the noise suppressor 203 is an analog circuit, the enhanced speech signal E1 is converted into a digital signal by an A/D converter and used for digital control. On the other hand, when the noise suppressor 203 is a digital circuit, a signal from the microphone is converted into a digital signal by an A/D converter before input to the noise suppressor 203. If both an analog circuit and a digital circuit are included, for example, the subtracter 301 or 303 can be formed from an analog circuit, and the adaptive filter 302 or 304 can be formed from an analog circuit controlled by a digital circuit.

The noise suppressor 203 shown in FIG. 3 is merely an example of a circuit suitable to this embodiment. Other than this arrangement, an existing circuit that subtracts the estimated noise signal Y1 from the signal X1 and outputs the enhanced speech signal E1 can also be used. For example, the adaptive filter 304 shown in FIG. 3 can be replaced with a circuit that outputs a predetermined level to filter a piece of diffused speech. In addition, the subtracter 301 and/or the subtracter 303 can be replaced with an integrator that represents the estimated noise signal Y1 or the estimated speech signal Y2 as a coefficient to multiply the signal X1 or X2.

<<Arrangement of Microphones>>

Figure 4:
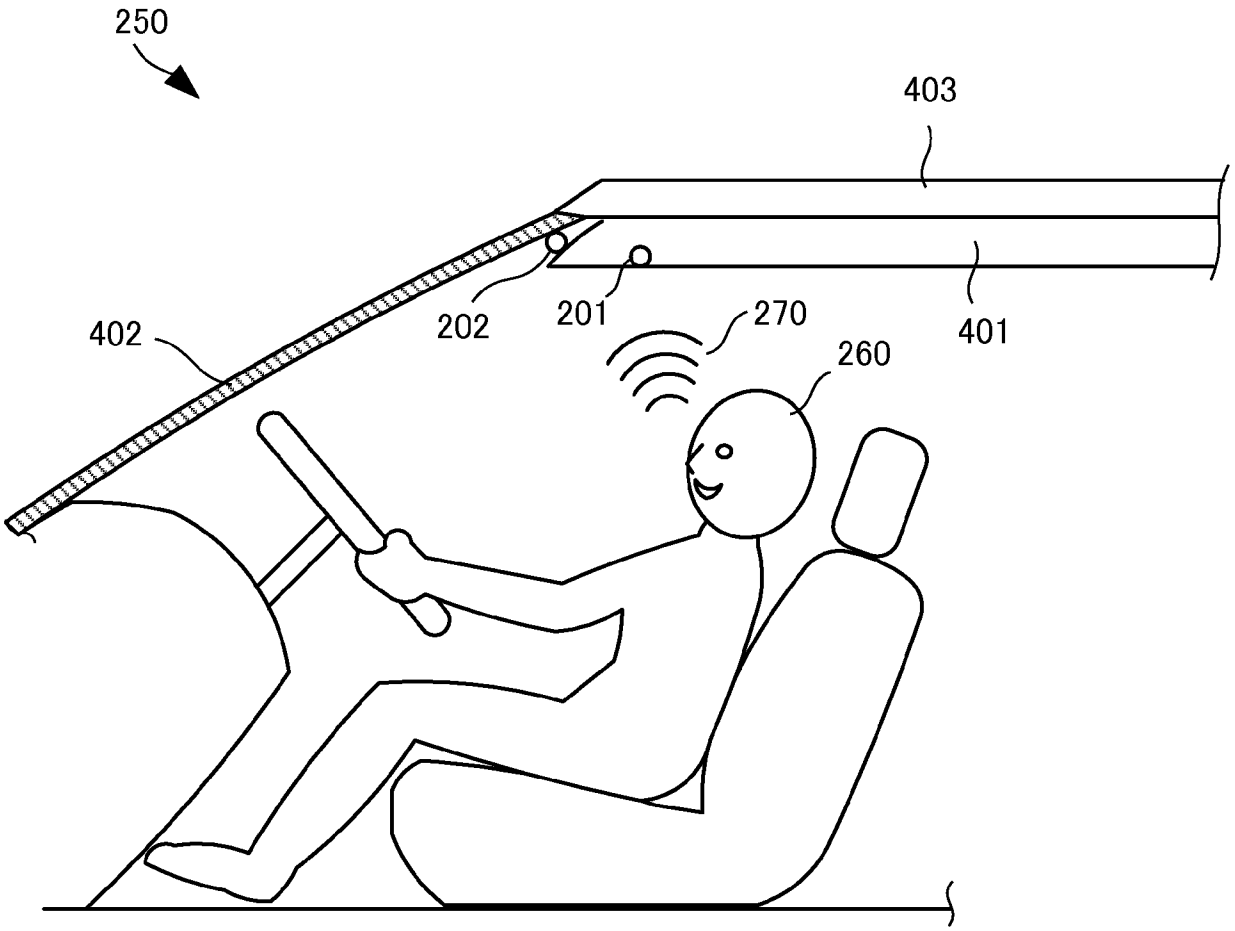
FIG. 4 is a view for explaining the microphone arrangement of the speech processing apparatus according to the second embodiment of the present invention.

FIG. 4 is a view for explaining the arrangement of the microphones 201 and 202 or a schematic sectional view showing the state in a car with a right-hand steering wheel viewed from the assistant driver's seat toward the driver's seat. In the vehicle 250, the microphone 201 is arranged on an internal ceiling member 401 above the passenger 260. More specifically, a hole is formed in the internal ceiling member 401 or an incidental structure of the ceiling member, and the microphone 201 is attached to the hole. In particular, when the microphone 201 is arranged on the upper front side of the passenger 260, the speech level of the passenger 260 rises, and a piece of high-quality enhanced speech can be obtained.

A windshield 402 is normally fixed to a body ceiling member 403 of the vehicle 250 by an adhesive or the like. The internal ceiling member 401 is separately attached to the body ceiling member 403. For this reason, a gap exists between the windshield 402 and the internal ceiling member 401. The microphone 202 is attached to the gap. An end of the internal ceiling member 401 thus insulates input of the voice 270 of the passenger 260 to the microphone 202.

Figure 5A:
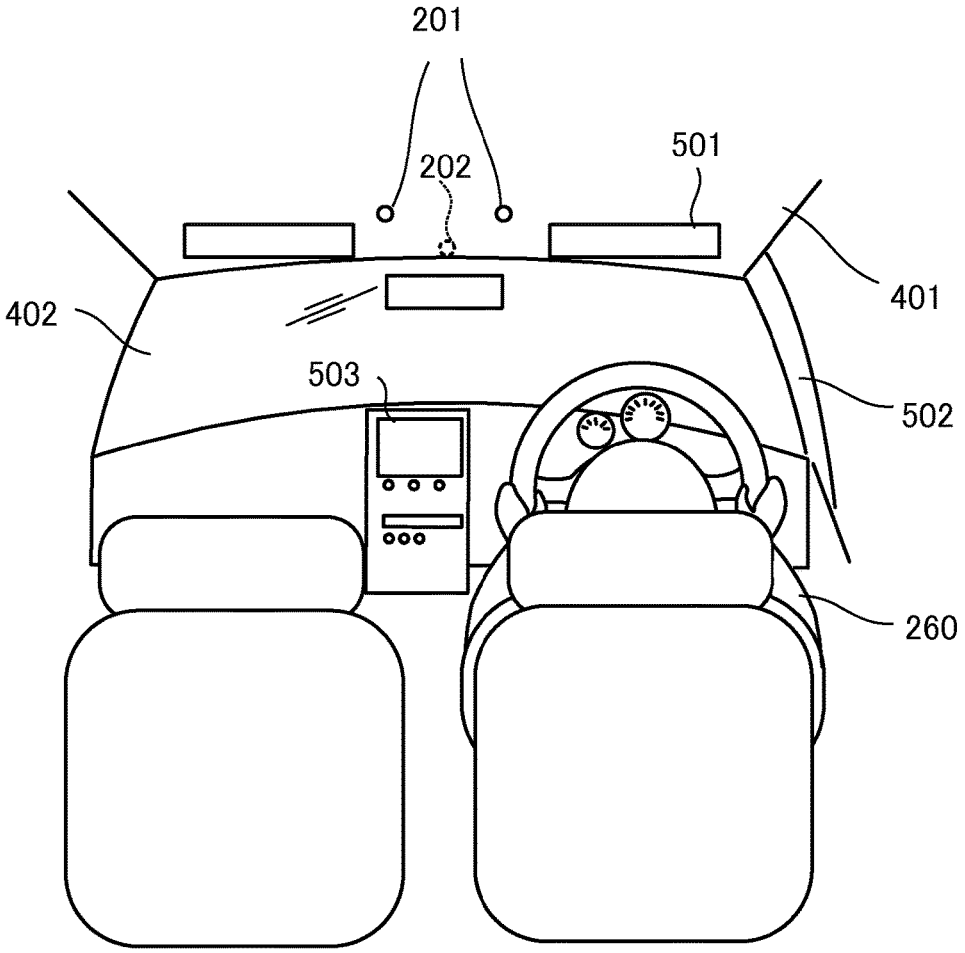
FIG. 5A is a view for explaining the microphone arrangement of the speech processing apparatus according to the second embodiment of the present invention.

FIG. 5A is a view for explaining an example of the arrangement of the microphones 201 and 202 or a schematic perspective view showing the state in a car with a right-hand steering wheel viewed from the back seat toward the driver's seat. Referring to FIG. 5A, there are provided two microphones 201 for the driver's seat and the assistant driver's seat. The microphone 202 hides behind the ceiling member 401. The microphone 201 may be provided above the passenger's head. In FIG. 5A, however, the microphone 201 is provided near the center while avoiding a sun visor 501. Note that wires (not shown) extending from the microphones 201 and 202 are connected to an ECU (Electronic Control Unit) (not shown) or a car navigation system 503 via an A pillar 502.

Figure 5B:
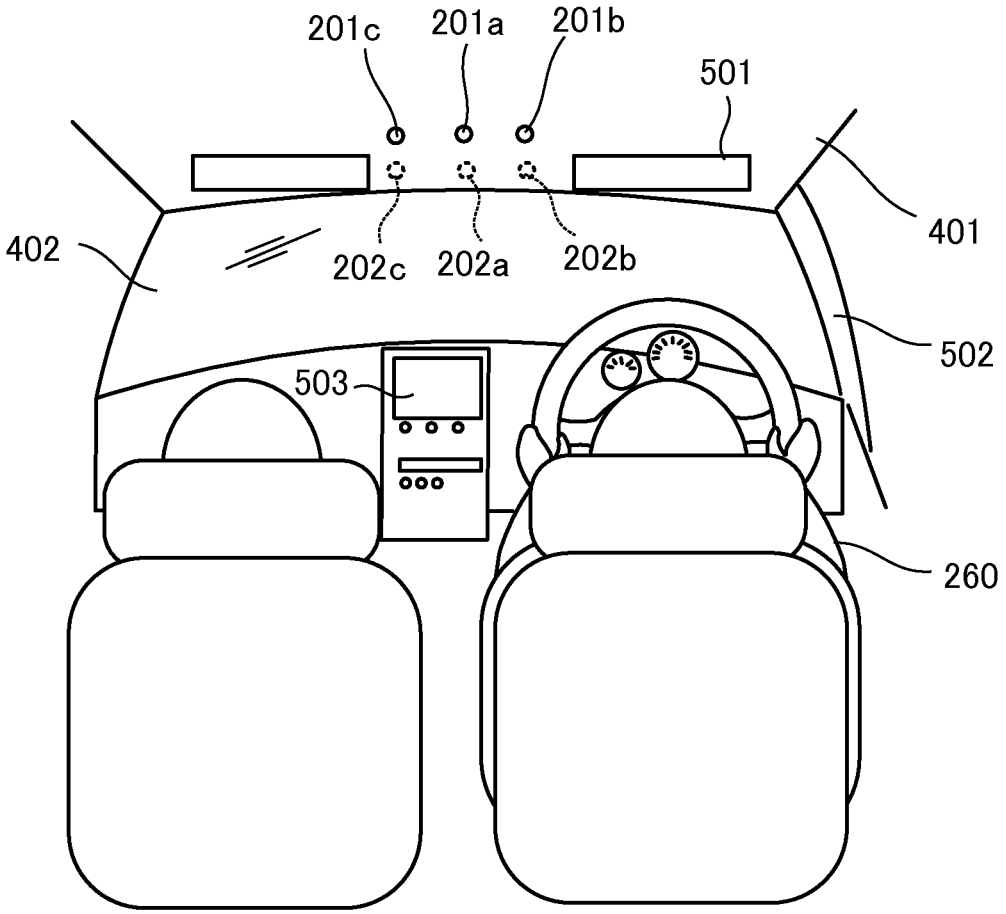
FIG. 5B is a view for explaining the microphone arrangement of the speech processing apparatus according to the second embodiment of the present invention.

FIG. 5B is a view for explaining another example of the arrangement of the microphones 201 and 202. When a microphone 201*a* is used as the first microphone, and a microphone 202*a* is used as the second microphone, they can be operated while being shared by the driver's seat side and the assistant driver's seat side. This is because the driver's seat and the assistant driver's seat are symmetric with respect to a line that connects the microphones 201*a* and 202*a*, and the distance from the microphones 201*a* and 202*a* to the driver's seat and the distance from the microphones to the assistant driver's seat almost equal. When a microphone 201*b* is used as the first microphone, and a microphone 202*b* is used as the second microphone, the microphone 201*b* is closer to the driver's seat as compared to the case where the microphones 201*a* and 202*a* are used. Hence, since the speech level of the driver 260 on the driver's seat side rises, this arrangement is suitable for the driver's seat. Similarly, when a microphone 201*c* is used as the first microphone, and a microphone 202*c* is used as the second microphone, the microphone 201*c* is closer to the assistant driver's seat. Hence, this arrangement is suitable for the passenger 260 on the assistant driver's seat side. Note that the two combinations of the microphones 201*b* and 202*b* and the microphones 201*c* and 202*c* may be used, and a signal selector that automatically selects one of, for example, the microphones 201*b* and 201*c* with a stronger signal may be provided. The technique of automatically selecting a microphone by a signal strength is a known technique, and a description thereof will be omitted here.

Similarly, it is possible to use the microphone 201*b* as the first microphone and the microphone 202*a* as the second microphone for the driver's seat and the microphone 201*c* as the first microphone and the microphone 202*a* as the second microphone for the assistant driver's seat. Alternatively, each of the microphones 201*b* and 201*c* may be used as the first microphone, the microphone 202*a* may be shared as the second microphone, and a signal selector that automatically selects one of the microphones 201*b* and 201*c* with a stronger signal may be provided. In this case, the number of constituent elements can be decreased by sharing the microphone 202*a*. Note that the expressions of "driver's seat side"

and "assistant driver's seat side" used here assume a car with a right-hand steering wheel but are not limited to these depending on the model.

In this embodiment, since the microphone configured to catch noise in the car is arranged in the gap between the windshield and the internal ceiling member, as described above, a high-quality enhanced speech signal can be obtained very easily without adding any new component to the conventional internal structure. It is possible to catch uniform noise from all directions by placing the microphone on the ceiling member.

Third Embodiment

Figure 6:
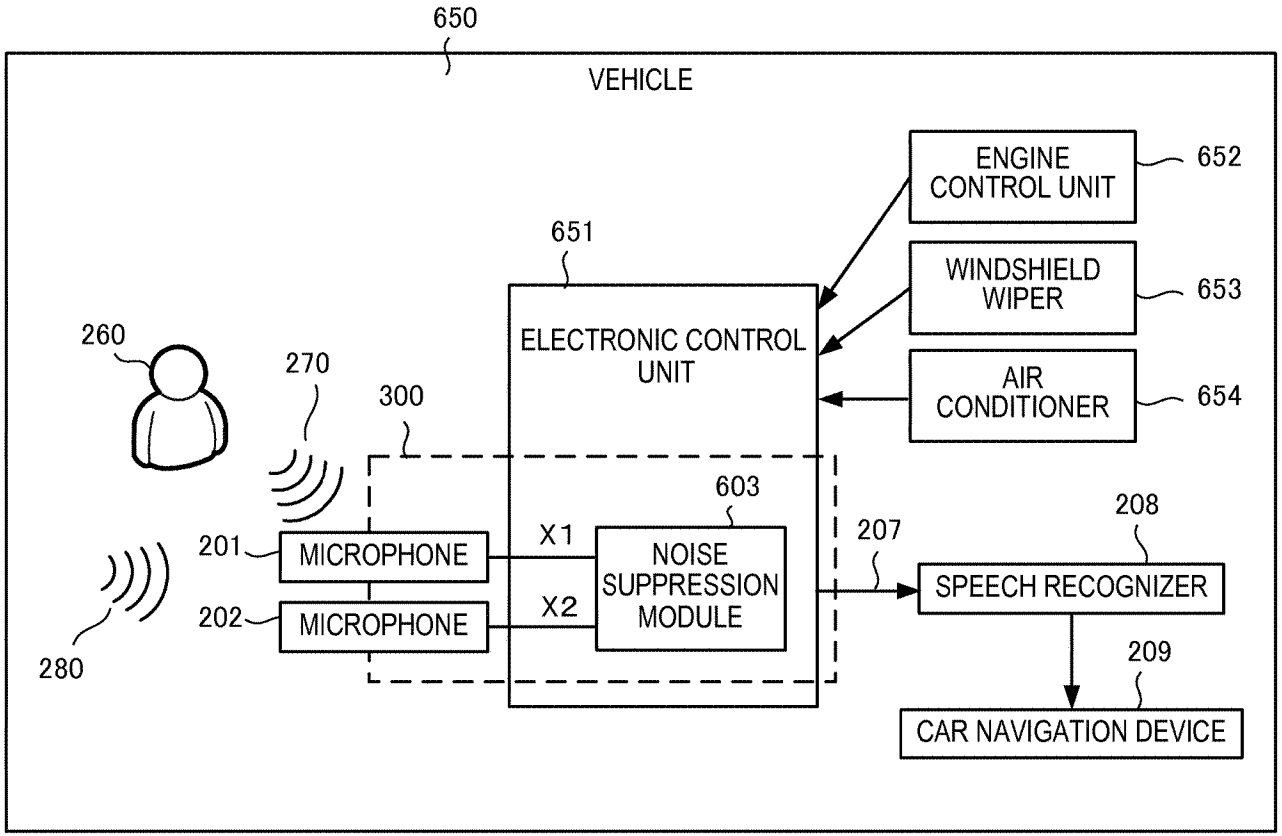
FIG. 6 is a block diagram showing the arrangement of a vehicle according to the third embodiment of the present invention.

A speech processing apparatus 300 according to the third embodiment of the present invention will be described next with reference to FIG. 6. FIG. 6 is a block diagram for explaining the schematic arrangement of the speech processing apparatus 300 according to this embodiment and its peripheral devices. The speech processing apparatus 300 according to this embodiment is different from the second embodiment in that a noise suppression module 603 incorporated in an electronic control unit (ECU) 651 is used. The rest of the components and operations is the same as in the second embodiment. Hence, the same reference numerals denote the same components and operations, and a detailed description thereof will be omitted. In particular, microphones 201 and 202 are assumed to be arranged at the same positions as in the second embodiment.

Referring to FIG. 6, the electronic control unit 651 inputs a signal representing a vehicle speed detected by an engine control unit 652, a control signal of a windshield wiper 653, and a control signal of an air conditioner 654 in the car, and transfers them to the noise suppression module 603. The noise suppression module 603 has the noise signal samples of, for example, road noise according to the vehicle speed, noise derived from the operation of the windshield wiper 653, noise of rain beating against the windshield, and wind noise caused by blowing from the air conditioner 654 in advance. The noise suppression module 603 switches the noise suppression method and level in accordance with various signals input by the electronic control unit 651, thereby improving the quality of an enhanced speech signal generated using the microphones 201 and 202.

For example, upon determining that the air conditioner 654 is operating, the noise suppression module 603 actively suppresses wind noise from the input signals of the microphones 201 and 202. At this time, the suppression level may be controlled by determining that the input signal from the microphone 202 includes a larger amount of wind noise as compared to the microphone 201.

For example, upon determining that the windshield wiper 653 is operating, the noise suppression module 603 actively suppresses the operation noise of the windshield wiper and the noise of rain from the input signals of the microphones 201 and 202. At this time, the suppression level may be controlled by determining that the input signal from the microphone 202 includes a larger amount of the operation noise of the windshield wiper and the noise of rain as compared to the microphone 201.

Note that the electronic control unit 651 physically includes, for example, a CPU (Central Processing Unit), a memory, and an input/output interface. The memory includes, for example, a ROM (Read Only Memory) and an HDD (Hard Disk Drive) which store programs and data to be processed by the CPU and a RAM (Random Access Memory) mainly used as various work areas for control processing. These elements are connected to each other via a bus. The CPU executes a program (for example, noise suppression module) stored in the ROM and processes a signal received via the input/output interface, a signal input from a microphone, data expanded on the RAM, and the like, thereby implementing the function as the speech processing apparatus 300.

As described above, according to this embodiment, the noise suppression method and level are changed in accordance with the operation of the vehicle, thereby obtaining an enhanced speech signal of higher quality.

Fourth Embodiment

Figure 7:
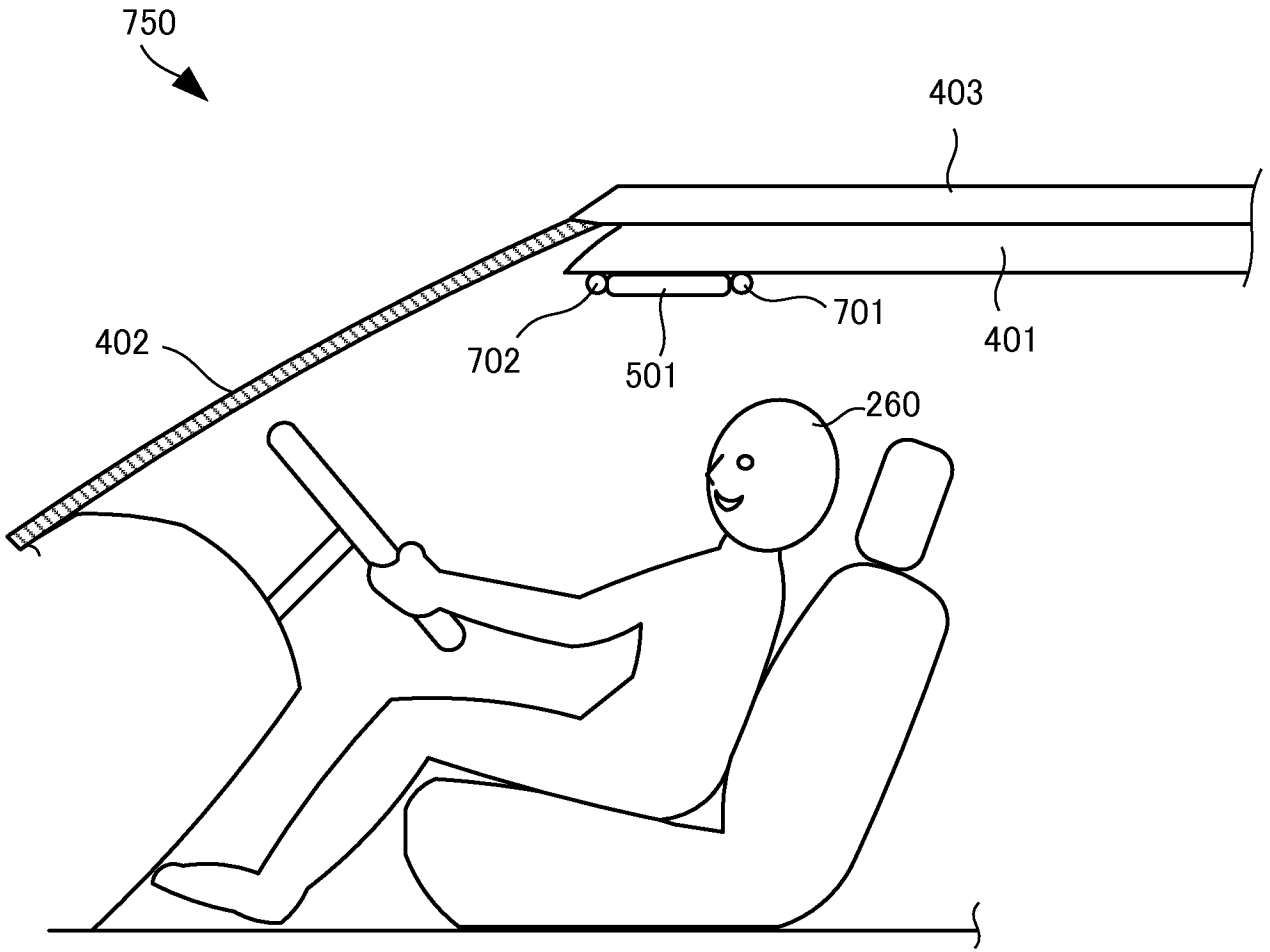
FIG. 7 is a view for explaining the microphone arrangement of a speech processing apparatus according to the fourth embodiment of the present invention.

A speech processing apparatus according to the fourth embodiment of the present invention will be described with reference to FIGS. 7 and 8. FIG. 7 is a view for explaining the attachment positions of microphones 701 and 702 included in the speech processing apparatus according to this embodiment. In this embodiment, the microphone 701 serving as a first microphone is attached near a sun visor 501 at a position closer to a passenger 260. On the other hand, the microphone 702 serving as a second microphone is attached near a sun visor 501 at a position far from the passenger 260. The rest of the components and operations is the same as in the second embodiment. Hence, the same reference numerals denote the same components and operations, and a detailed description thereof will be omitted.

Figure 8:
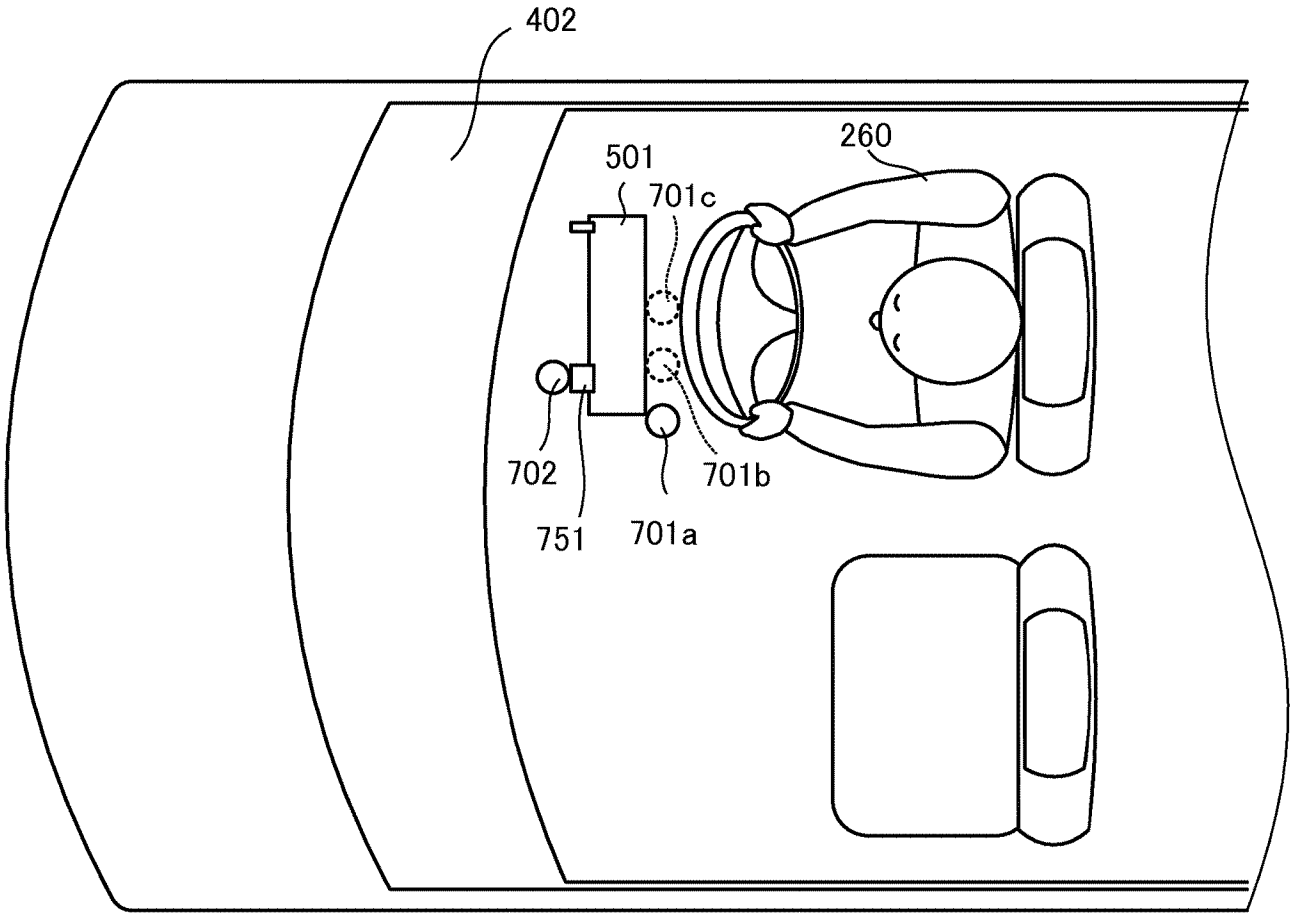
FIG. 8 is a view for explaining the microphone arrangement of the speech processing apparatus according to the fourth embodiment of the present invention.

As shown in FIG. 8, the microphone 701 is provided on the passenger side of the sun visor 501. FIG. 8 illustrates three placement position candidates. It is possible to employ one of a microphone 701*a* placed at a position of the sun visor 501 closest to the center, a microphone 701*b* placed at a position facing the microphone 702, and a microphone 701*c* placed at a position facing the passenger 260. The microphone 702 is arranged near the base of a clip portion 751 of the sun visor 501. Since the clip portion 751 insulates the voice of the passenger 260, a stronger speech signal is input to the microphone 701 as compared to the microphone 702. Hence, according to the microphone arrangement of this embodiment, a high-quality enhanced speech signal can be obtained.

Fifth Embodiment

Figure 9:
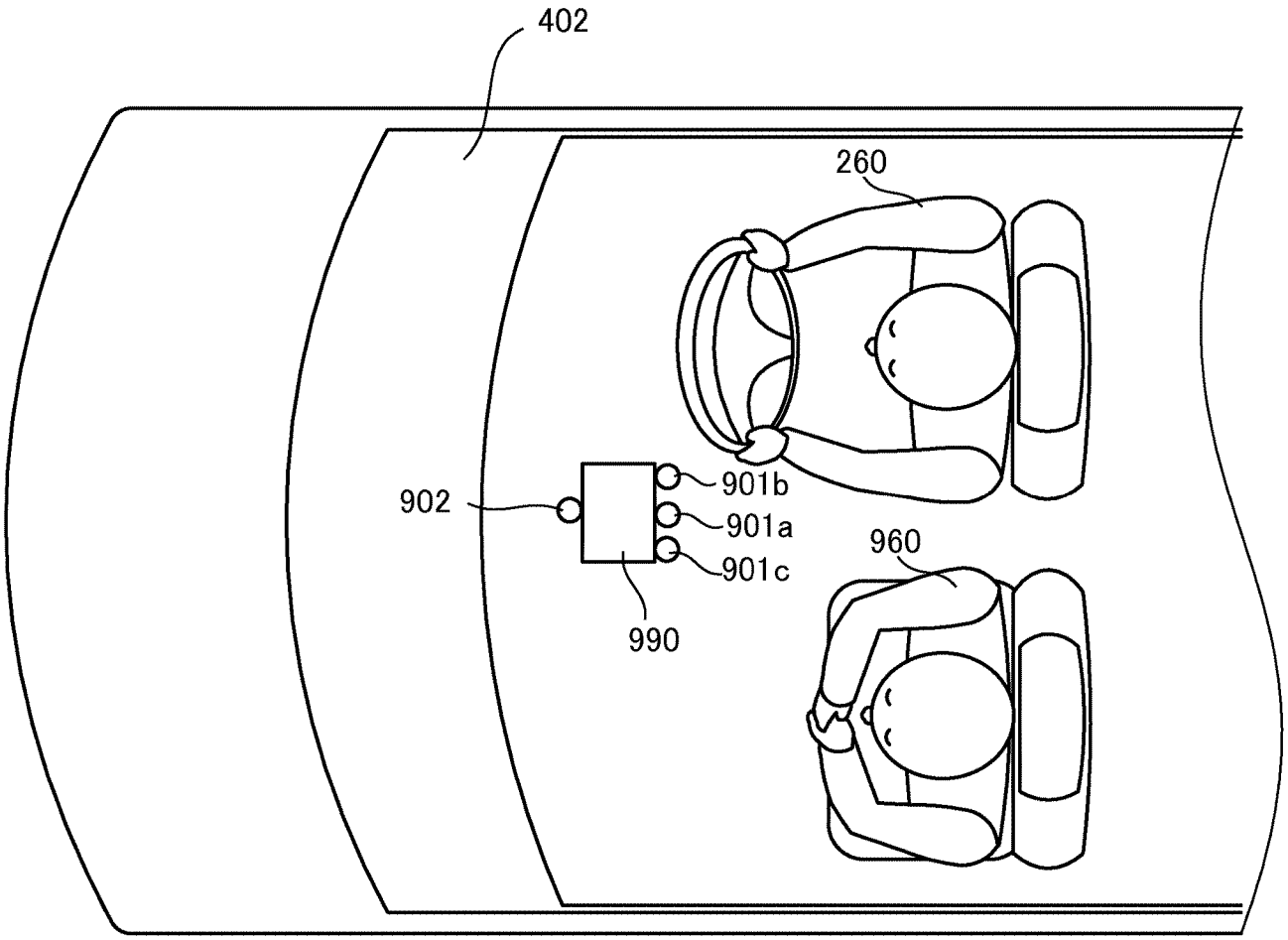
FIG. 9 is a view for explaining the microphone arrangement of a speech processing apparatus according to the fifth embodiment of the present invention.

A speech processing apparatus according to the fifth embodiment of the present invention will be described with reference to FIG. 9. FIG. 9 is a view for explaining the attachment positions of microphones 901 and 902 included in the speech processing apparatus according to this embodiment. In this embodiment, the microphone 901 serving as a first microphone is attached near an overhead console (including a map lamp and a sunglass holder) 990 at a position closer to a passenger 260 or 960. On the other hand, the microphone 902 serving as a second microphone is attached near the overhead console 990 at a position far from the passenger 260 or 960. The rest of the components and operations is the same as in the second embodiment. Hence, the same reference numerals denote the same components and operations, and a detailed description thereof will be omitted.

The microphone 902 is arranged ahead of the overhead console 990. Since the overhead console 990 insulates the voice of the passenger 260, a stronger speech signal is input to the microphone 901 as compared to the microphone 902.

Hence, according to the microphone arrangement of this embodiment, a high-quality enhanced speech signal can be obtained.

As for the microphone arrangement, a plurality of combinations are possible, as in FIG. 5B. That is, the combination of a microphone 901*a* and the microphone 902 can be shared by the driver's seat and the assistant driver's seat. As the arrangement dedicated to the driver's seat, the combination of a microphone 901*b* and the microphone 902 can be used. As the arrangement dedicated to the assistant driver's seat, the combination of a microphone 901*c* and the microphone 902 can be used. The microphones 901*b* and 901*c* and the microphone 902 may be placed, as a matter of course. The microphone 902 is shared by the driver's seat and the assistant driver's seat, and the microphone 901*b* for the driver's seat and the microphone 901*c* for the assistant driver's seat are selectively used.

Sixth Embodiment

Figure 10:
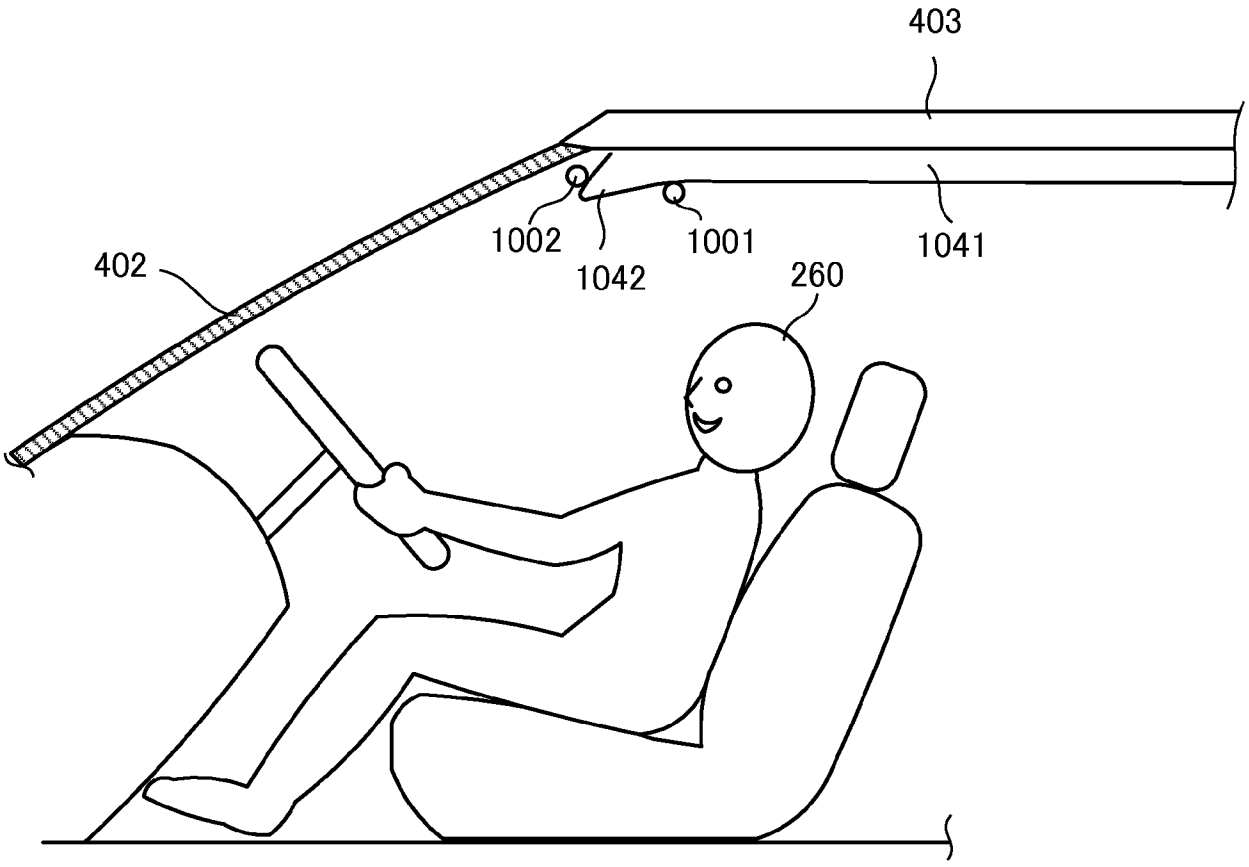
FIG. 10 is a view for explaining a ceiling member and the microphone arrangement of a speech processing apparatus according to the sixth embodiment of the present invention.
Figure 11:
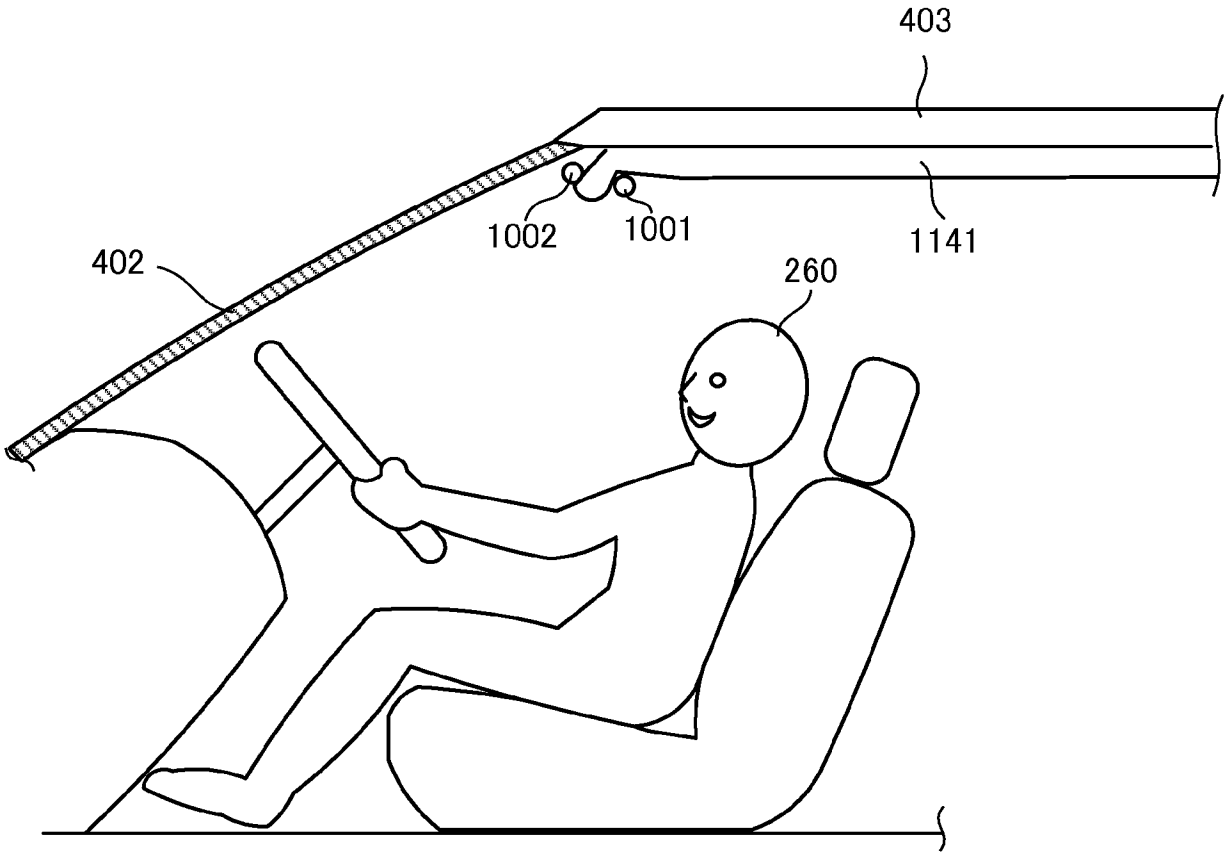
FIG. 11 is a view for explaining the ceiling member and the microphone arrangement of the speech processing apparatus according to the sixth embodiment of the present invention.
Figure 12:
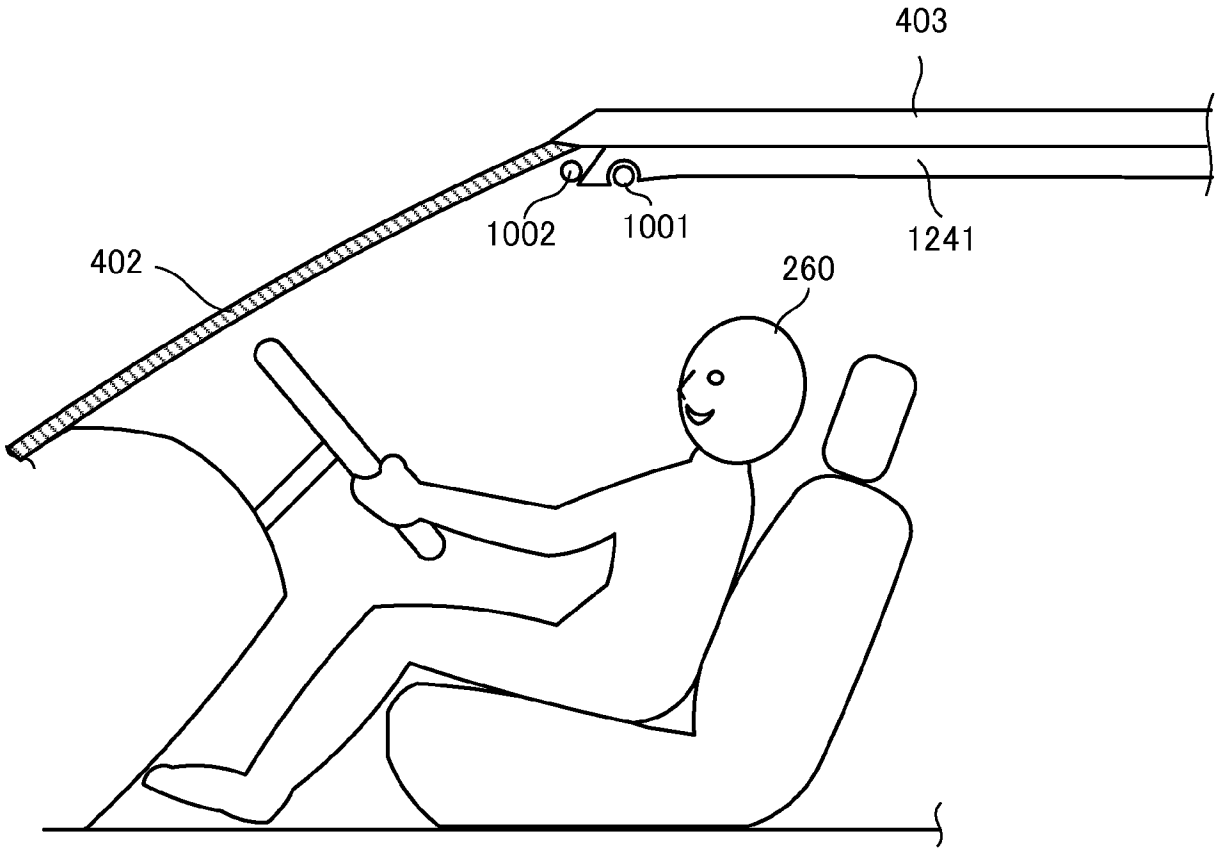
FIG. 12 is a view for explaining the ceiling member and the microphone arrangement of the speech processing apparatus according to the sixth embodiment of the present invention.

A speech processing apparatus according to the sixth embodiment of the present invention will be described with reference to FIG. 10. FIG. 10 is a view for explaining the attachment positions of microphones 1001 and 1002 included in the speech processing apparatus according to this embodiment. In this embodiment, a portion (for example, an end in FIG. 10) of a ceiling member 1041 in the vehicle projects downward and forms a projecting portion (or protruding portion) 1042. However, the projecting portion or protruding portion 1042 may be a protruding portion formed by a portion of the ceiling member 1041 protruding downward or a downward projection. That is, the microphone 1001 serving as a first microphone is provided above a passenger 260. The ceiling member 1041 itself has a special shape so that the voice of the passenger 260 hardly enters the microphone 1002 serving as a second microphone. As a characteristic feature, the special shape does not form an obstructive hindrance when the passenger 260 is viewed from the microphone 1001 but does when the passenger 260 is viewed from the microphone 1002. Any thick polygonal shape can be assumed as the shape. Especially effective is a ceiling member (ceiling member 1141 shown in FIG. 11) having a V-shaped opening toward the passenger or a ceiling member (ceiling member 1241 shown in FIG. 12) having a U-shaped opening toward the passenger. The rest of the components and operations is the same as in the second embodiment. Hence, the same reference numerals denote the same components and operations, and a detailed description thereof will be omitted.

Since the projecting portion 1042 insulates the voice of the passenger 260, a stronger speech signal is input to the microphone 1001 as compared to the microphone 1002. Hence, according to the microphone arrangement of this embodiment, a high-quality enhanced speech signal can be obtained.

Other Embodiments

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

The present invention is applicable to a system including a plurality of devices or a single apparatus. The present invention is also applicable even when an information processing program for implementing the functions of the embodiments is supplied to the system or apparatus directly or from a remote site. Hence, the present invention also incorporates the program installed in a computer to implement the functions of the present invention on the computer, a medium storing the program, and a WWW (World Wide Web) server that causes a user to download the program. Especially, the present invention incorporates at least a non-transitory computer readable medium.

This application claims the benefit of Japanese Patent Application No. 2013-025001 filed on Feb. 12, 2013, which is hereby incorporated by reference herein in its entirety.

The invention claimed is:

1. A speech processing apparatus comprising:

a first microphone that is provided on one of a ceiling member in a vehicle and an accessory thereof, inputs a sound mixture including a voice of a passenger of the vehicle and noise in the vehicle, and outputs a first signal;

a second microphone that is provided in a gap between the ceiling member and a windshield of the vehicle, inputs the noise in the vehicle while insulating the voice of the passenger of the vehicle using one of the ceiling member of the vehicle and the accessory thereof, and outputs a second signal; and a noise suppressor that outputs an enhanced speech signal based on the first signal and the second signal.

2. The speech processing apparatus according to claim 1, wherein said second microphone converts the noise in the vehicle into the second signal while insulating the voice of the passenger of the vehicle using one of a projecting portion, a protruding portion, and a projection downward from one of the ceiling member of the vehicle and the accessory thereof.

3. The speech processing apparatus according to claim 1, wherein said first microphone comprises a plurality of first microphones, and the apparatus further comprises a signal selector that uses a signal of said first microphone arranged at a position closer to the passenger who has uttered the voice out of said plurality of first microphones.

4. The speech processing apparatus according to claim 1, wherein said second microphone is provided in a gap between the ceiling member and a windshield of the vehicle.

5. The speech processing apparatus according to claim 1, wherein during an operation of an air conditioner in the vehicle, said noise suppressor determines that wind noise is input to said first microphone and said second microphone, suppresses a signal derived from the wind noise from the first signal and the second signal, and outputs the enhanced speech signal.

6. The speech processing apparatus according to claim 1, wherein said first microphone is provided on one of a map lamp, a sun visor, a sunglass holder, and an overhead console as the accessory of the ceiling member.

7. The speech processing apparatus according to claim 1, wherein said second microphone is attached at a position where the accessory of the ceiling member insulates the voice of the passenger directed to said second microphone.

8. A speech processing method comprising:

inputting a sound mixture including a voice of a passenger of a vehicle and noise in the vehicle and outputting a first signal using a first microphone provided on one of a ceiling member in the vehicle and an accessory thereof;

inputting the noise in the vehicle while insulating the voice of the passenger of the vehicle using one of the ceiling member of the vehicle and the accessory thereof and outputting a second signal, using a second microphone that is provided in a gap between the ceiling member and a windshield of the vehicle; and outputting an enhanced speech signal based on the first signal and the second signal.

* * * * *